US005830246A

United States Patent [19]

Dunlop

[11] Patent Number: 5,830,246

[45] Date of Patent: Nov. 3, 1998

[54] PROCESS FOR PROCESSING COAL

[75] Inventor: Donald D. Dunlop, Miami, Fla.

[73] Assignee: Fuels Management, Inc., Miami, Fla.

[21] Appl. No.: 811,127

[22] Filed: Mar. 3, 1997

[51] Int. Cl.[6] ..... C10L 1/32; C10L 9/00

[52] U.S. Cl. ..... 44/626; 44/280; 44/620

[58] Field of Search ..... 44/626

[56] References Cited

U.S. PATENT DOCUMENTS

| | | | |
|---|---|---|---|
| 4,309,192 | 1/1982 | Kubo et al. | 44/626 |
| 5,035,721 | 7/1991 | Atherton | 44/626 |
| 5,527,365 | 6/1996 | Coleman et al. | 44/626 |
| 5,556,436 | 9/1996 | Yagaki et al. | 44/626 |
| 5,587,085 | 12/1996 | Yoon et al. | 44/626 |

*Primary Examiner*—Ellen M. McAvoy
*Attorney, Agent, or Firm*—Howard J. Greenwald

[57] ABSTRACT

A process for preparing an irreversibly dried coal in which coal with a moisture content of from about 5 to about 30 percent and a combined oxygen content of from about 10 to about 20 percent, and mineral oil with an initial boiling point of at least about 900 degrees Fahrenheit, are fed to a fluidized bed reactor with a fluidized bed density of from about 10 to about 40 pounds per cubic foot. The coal becomes coated with the mineral oil, and the coated coal is maintained within the fluidized bed at a temperature of from about 225 to about 500 degrees Fahrenheit for from about 1 to about 5 minutes while simultaneously comminuting and dewatering the coated coal.

17 Claims, 1 Drawing Sheet

PROCESS FOR PROCESSING COAL

FIELD OF THE INVENTION

A process for irreversibly removing moisture from coal while simultaneously reducing its particle size.

BACKGROUND OF THE INVENTION

Many coals contain up to about 30 weight percent of moisture. This moisture not only does not add to the fuel value of the coal, but also is relatively expensive to transport.

Consequently, many processes have been developed to dry coal. Illustrative of these processes is one disclosed in U.S. Pat. No. 4,324,544 of Blake, in which coal is dried in a fluidized bed in which the heat necessary for drying is provided by partial combustion of the coal in the bed. By way of further illustration, U.S. Pat. No. 4,495,710 of Ottosan discloses a drying process in which particulate low rank coal is dried in a fluidized bed in which the coal is fluidized above a first portion of a gas flow distributor using a hot fluidizing gas, and also above a second portion of the gas flow distributor using a recycle gas stream at a temperature less than about 200 degrees Fahrenheit. The disclosure of each of these United States patents is hereby incorporated by reference into this specification.

The coal produced by the processes of the Blake and Ottosan patents suffers from two major disadvantages. In the first place, the drying process is reversible, and when the coal is allowed to stand in the presence of a moisture-laden atmosphere, it regains some or all of its initial water content. In the second place, the coal is often likely to undergo spontaneous combustion upon standing in air.

It is an object of this invention to provide a process for irreversibly removing moisture from coal.

It is another object of this invention to provide a process for producing coal which is not likely to undergo spontaneous combustion.

It is yet another object of this invention to provide a process for comminuting coal without using mechanical grinding means.

It is yet another object of this invention to provide a novel coal-water slurry.

SUMMARY OF THE INVENTION

In accordance with this invention, there is provided a process in which a specified coal is charged to a fluidized bed at a temperature of from about 225 to about 500 degrees Fahrenheit, from about 0.5 to about 3.0 weight percent of oil with a boiling point in excess of 900 degrees Fahrenheit is charged to the fluidized bed, the coal in the bed is comminuted, a fine fraction of the comminuted coal is then removed from the bed, and this fine fraction of coal is be mixed with water and a coarse coal fraction to make a coal-water slurry.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
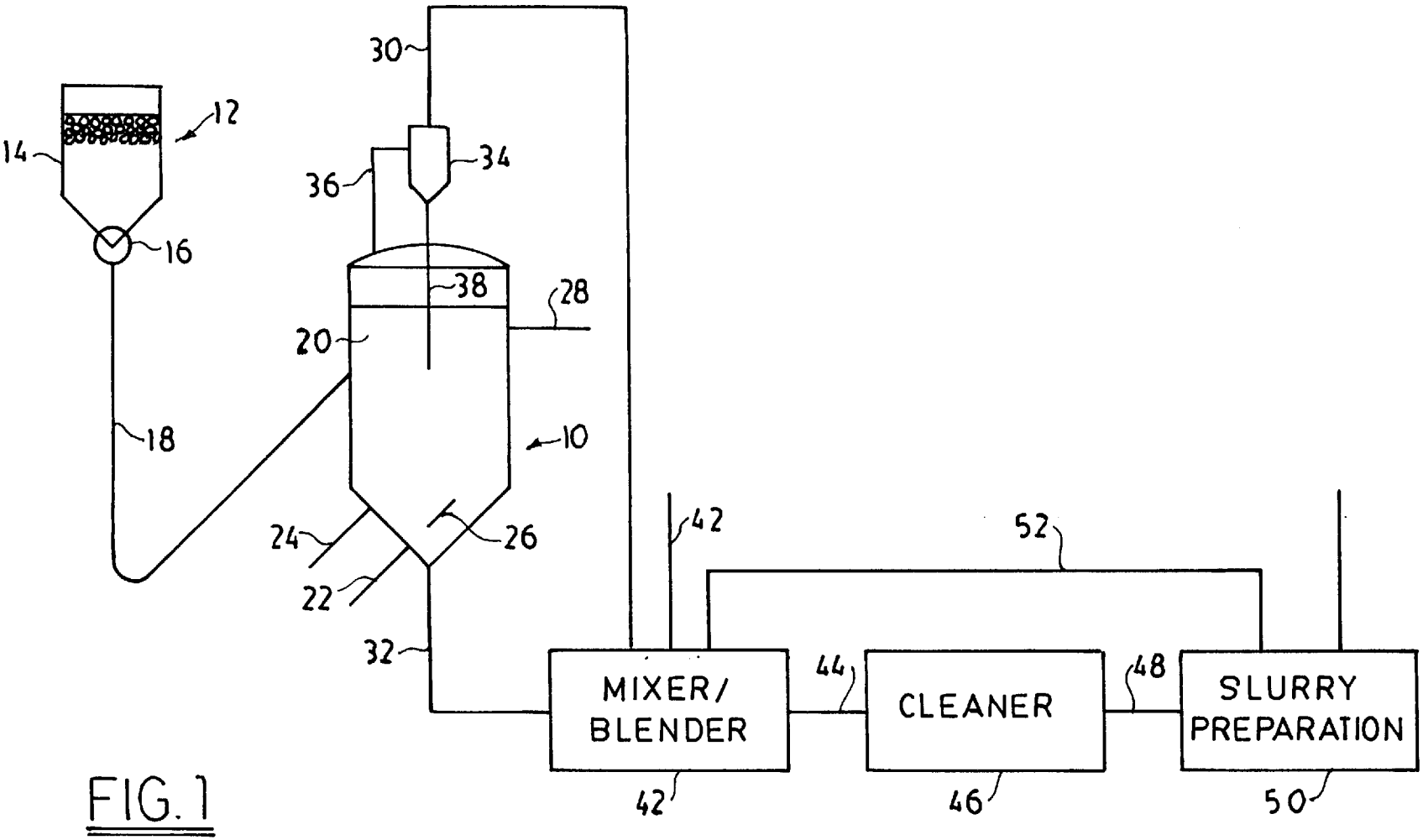
FIG. 1 is a schematic diagram of one preferred process of the instant invention.

In the preferred process illustrated in FIG. 1, coal is charged to a fluidized bed reactor 10, preferably by means of coal feeder assembly 12.

It is preferred that the coal used in the process of FIG. 1 contain from about 5 to about 30 weight percent of moisture and, more preferably, from about 10 to about 30 weight percent of moisture. As is known to those skilled in the art, the moisture content of coal may be determined by conventional means in accordance with standard A.S.T.M. testing procedures. Means for determining the moisture content of coal are well known in the art; see, e.g., U.S. Pat. Nos. 5,527,365 (irreversible drying of carbonaceous fuels), 5,503,646, 5,411,560 (production of binderless pellets from low rank coal), 5,396,260, 5,361,513 (apparatus for drying and briquetting coal), 5,327,717, and the like. The entire disclosure of each of these United States patents is hereby incorporated by reference into this specification.

It is also preferred that the coal used in the process of FIG. 1 contain from about 10 to about 20 weight of combined oxygen, in the form, e.g., of carboxyl groups, carbonyl groups, and hydroxyl groups. As used in this specification, the term "combined oxygen" means oxygen which is chemically bound to carbon atoms in the coal. See, e.g., H.H. Lowry, editor, "Chemistry of Coal Utilization" (John Wiley and Sons, Inc., New York, N.Y., 1963).

The combined oxygen content of such coal may be determined, e.g., by standard analytical techniques; see, e.g., U.S. Pat. Nos. 5,444,733, 5,171,474, 5,050,310, 4,852,384 (combined oxygen analyzer), 3,424,573, and the like. The disclosure of each of these United States patents is hereby incorporated by reference into this specification.

In one embodiment, the coal charged to feeder 12 contains at least about 10 weight percent of ash. As used herein, the term ash refers to the inorganic residue left after the ignition of combustible substances; see, e.g., U.S. Pat. Nos. 5,534,137 (high ash coal), 5,521,132 (raw coal fly ash), 4,795,037 (high ash coal), 4,575,418 (removal of ash from coal), 4,486,894 (method and apparatus for sensing the ash content of coal), and the like. The disclosure of each of these United States patents is hereby incorporated by reference into this specification.

By way of further illustration, one suitable ash containing coal which may be used in this embodiment is Herrin number 6 coal, from Illinois.

Referring again to FIG. 1, the coal which is added to feeder assembly 12 may be, e.g., lignite, subbituminous, and bituminous coals. These coals are described in applicant's U.S. Pat. No. 5,145,489, the entire disclosure of which is hereby incorporated by reference into this specification.

The coal charged to feeder assembly 12 preferably is 2 by ¼" or smaller. As is known to those skilled in the art, 2 by ¼" coal has the majority of its particles within the range of from about 0.25 to about 20 inches.

Feeder assembly 12 can be any coal feeder assembly commonly used in the art. Thus, e.g., one may use one or more of the coal feeders described in U.S. Pat. Nos. 5,265,774, 5,030,054 (mechanical/pneumatic coal feeder), 4,497,122 (rotary coal feeder), 4,430,963, 4,353,427 (gravimetric coal feeder), 4,341,530, 4,142,868 (rotary piston coal feeder), 4,140,228 (dry piston coal feeder), 4,071,151 (vibratory high pressure coal feeder with helical ramp), 4,025,317, and the like. The disclosure of each of these United States patents is hereby incorporated by reference into this specification.

Referring again to FIG. 1, and in the preferred embodiment depicted therein, it will be seen that feeder assembly 12 is comprised of hopper 14 and star feeder 16. As is known to those skilled in the art, the star feeder is a metering device, which may be operated by a controller (not shown) which controls the rate of coal removal from the hopper 14); see, e.g., U.S. Pat. No. 5,568,896, the disclosure of which is hereby incorporated by reference into this specification.

It is preferred that feeder assembly 12 be capable of continually delivering coal via line 18 to fluidized bed 20.

Referring again to FIG. 1, a fluidized bed 20 is provided in a reactor vessel 10. The fluidized bed 20 is comprised of a bed of fluidized coal particles, and it preferably has a density of from about 10 to about 40 pounds per cubic foot. In one embodiment, the density of the fluidized bed 20 is from about 20 to about 30 pounds per cubic foot. As will be apparent to those skilled in the art, the fluidized bed density is the density of the bed while its materials are in the fluid state and does not refer to the particulate density of the materials in the bed.

Fluidized bed 20 may be provided by any of the means well known to those skilled in the art. Reference may be had, e.g., to applicant's U.S. Pat. No. 5,145,489, the entire disclosure of which is hereby incorporated by reference into this specification. Reference also may be had to U.S. Pat. Nos. 5,547,549, 5,546,875 (heat treatment of coal in a fluidized bed reactor), 5,197,398 (separation of pyrite from coal in a fluidized bed), 5,087,269 (drying fine coal in a fluidized bed), 4,571,174 (drying particulate low rank coal in a fluidized bed), 4,495,710 (stabilizing particulate low rank coal in a fluidized bed), 4,324,544 (drying coal by partial combustion in a fluidized bed), and the like. The disclosure of each of these United States patents is hereby incorporated by reference into this specification.

Referring again to FIG. 1, and in the preferred embodiment depicted therein, fluidized bed 20 is preferably maintained at a temperature of from about 225 to about 500 degrees Fahrenheit. In a more preferred embodiment, the fluidized bed is maintained at a temperature of from about 250 to about 450 degrees Fahrenheit.

Various means may be used to maintain the temperature of fluidized bed 20 at from about 225 to about 500 degrees Fahrenheit. Thus, e.g., one may use an internal or external heat exchanger (not shown). See, e.g., U.S. Pat. Nos. 5,537,941, 5,471,955, 5,442,919, 5,477,850, 5,426,932, and the like, the disclosures of each of which are hereby incorporated by reference into this specification.

In the preferred embodiment depicted in FIG. 1, air and/or water may be introduced into the fluidized bed 20 to control its temperature.

Thus, referring again to FIG. 1, air may be flowed into the system via line 22. The air may be at ambient temperature, or it may be heated, as required to maintain the desired temperature within fludized bed 20.

Thus, by way of further illustration, and again referring to FIG. 1, liquid water may be introduced via line 24. Again, depending upon the temperature control desired, the liquid water may be at ambient temperature.

It will be apparent to those skilled in process control that the quantities of air and/or water, and their temperatures, may be varied to maintain the desired temperature within the fluidized bed 20.

The temperature within fluidized bed 20 may be monitored by conventional means such as, e.g., by means of thermocouple 26.

The coal fed to fluidized bed 20 from feeder 12 preferably is maintained in fluidized bed 20 for from about 1 to about 5 minutes, and preferably for from about 2 to about 3 minutes, while being subjected to the aforementioned temperature of from about 225 to about 500 degrees Fahrenheit.

Referring again to FIG. 1, and in the preferred process depicted therein, oil is fed via line 28 into fluidized bed 20.

The oil used in the process depicted in FIG. 1 preferably has an initial boiling point of at least 900 degrees Fahrenheit. Thus, e.g., one may use a mineral oil with an initial boiling point of at least 900 degrees Fahrenheit. As is known to those skilled in the art, mineral oils are derived from petroleum, coal, shale and the like and consist essentially of hydrocarbons.

By way of illustration, and not limitation, one may use residual fuel oil, heavy crude oil, coal tars, and the like, as long as they have an initial boiling point at least about 900 degrees Fahrenheit. As is known to those skilled in the art, the initial boiling point of a mineral oil is the recorded temperature when the first drop of distilled vapor is liquefied and falls from the end of the condenser. See, e.g., U.S. Pat. Nos. 5,451,312 (initial boiling point of a hydrocarbon fraction), 5,382,728 (initial boiling point of a hydrocarbon blend), 5,378,739, 5,370,808 (initial boiling point of a petroleum oil), and the like. The disclosure of each of these United States patents is hereby incorporated by reference into this specification.

In one embodiment, the oil used is residual fuel oil. As is known to those skilled in the art, residual fuel oil, which is also often referred to as "residual oil," refers to the combustible, viscous, or semiliquid bottoms produced from crude oil distillation. See, e.g., U.S. Pat. Nos. 4,512,774, 4,462,810, 4,404,002, 4,297,110, 3,977,823, 3,691,063, and the like. The entire disclosure of each of these United States patents is hereby incorporated by reference into this specification.

Referring again to FIG. 1, the oil fed via line 28 preferably is fed at rate so that, within fluidized bed 20, from about 0.5 to about 3.0 weight percent of such oil is present, based upon the weight of dried coal (coal containing less than 2.0 percent of moisture) withdrawn from fluidized bed 20. Thus, e.g., for every 100 parts of dried coal withdrawn from fluidized bed 20 per unit of time, from about 0.5 to about 3.0 parts of oil would be contained thereon and, thus, would have to be introduced via line 28 to produce the desired condition.

The dried coal produced in applicant's process contains from about 0.5 to about 3.0 weight percent of oil (by weight dried coal), and from about 0 to about 2.0 weight percent of moisture.

Applicant has discovered that, unexpectedly, the use of his process produces a comminution of the coal fed into the fluidized bed. Typically, the particle size of the dried coal is such that at least about 80 weight percent of its particles are smaller than about 74 microns.

Without wishing to be bound to any particular theory, applicant believes that, in his process, the coal is caused to disintegrate by the escape of steam from the coal at an extremely high rate.

The coal produced by applicant's process not only has a relatively small particle size, but it also is irreversibly dried. Thus, when such coal is allowed to sit in an ambient environment at a temperature of 25 degrees Centigrade and a relative humidity of exceeding 50%, it will pick up less than 2.0 percent of moisture from this environment in 48 hours.

Referring again to FIG. 1, it will be apparent that, in the preferred embodiment depicted, the finer coal portions will be entrained from the top of the fluidized bed 20 to the cyclone 34, via line 36. The coarser component of the entrained stream will be returned to the bed via line 38.

Samples from fluidized bed 20 may be removed from line 32; as will be apparent to those skilled in the art, these samples will have a substantially broader particle size range than the samples removed via line 30.

The samples removed via lines 30 and 32 are then passed to mixer/blender 40, wherein they are preferably quenched with water via line 42. The samples are blended in mixer/blender 40 until they have a desired particle size distribution.

In one preferred embodiment, the blending occurs in such a manner to approach or achieve the particle size distribution disclosed in U.S. Pat. No. 4,282,006; the entire disclosure of this patent is hereby incorporated by reference into this specification. If the nature of the coal fractions in lines 30 and 32 are not suitable for making such particle size distribution, one or both of these streams may be further ground as disclosed in such patent.

Referring again to FIG. 1, and in one preferred embodiment, after the coal segments have been blended in blender 40 they then may be passed via line 44 to cleaner 46 wherein they can be beneficiated in a conventional manner such as, e.g., by froth flotation. Froth flotation cleaning of coal is well known; see, e.g., U.S. Pat. Nos. 5,379,902, 4,820,406, 4,770,767, 4,701,257, 4,676,804, 4,632,750, 4,532,032, and the like. The disclosure of each of these United States patents is hereby incorporated by reference into this specification.

Cleaned coal from cleaner 46 may be passed via line 48 to slurry preparation tank 50, and/or unbeneficiated coal from mixer blender 42 may be passed via line 52 to slurry preparation tank 50. In either case, it is preferred to treat said coal and/or combine it with additional reagents such as, e.g., water, dispersing agent(s), etc. (which may be added, e.g., via line 54) in order to obtain a slurry with specified properties.

One of the desired specified properties is that the slurry be comprised of from about 60 to about 82 weight percent of coal, from about 18 to about 40 weight percent of carrier liquid (such as, e.g., water), and from about 0.1 to about 4.0 weight percent, by weight of dry coal, of dispersing agent.

Another of the desired specified properties is that the slurry consist have a specific surface area of from about 0.8 to about 4.0 square meters per cubic centimeter and an interstitial porosity of less than 20 volume percent.

Yet another of the desired specified properties is that the slurry have a particle size distribution such that from about 5 to about 70 weight percent of the particles of coal in the slurry are of colloidal size, being smaller than about 3 microns.

One may prepare a slurry with these desired properties by the method disclosed in U.S. Pat. No. 4,477,259. The entire disclosure of this patent is hereby incorporated by reference into this specification.

The slurry produced in applicant's process possesses some unexpected, beneficial results. Thus, this slurry is substantially more combustible than prior art slurries.

Means for evaluating the combustibility of various fuels, and the factors which affect such combustibility, are well known. Reference may be had to U.S. Pat. Nos. 5,524,594 (combustibility of motor fuel), 5,463,997, 5,407,560 (combustibility of petroleum coke), 4,968,396 (combustibility of oxygenated hydrocarbon fuel), 4,3351, 889 (combustibility of fuel gas), 4,334,889 (combustibility of liquid fuel), 4,132,780 (combustibility of soid fuels), and the like. The entire disclosure of each of these United States patents is hereby incorporated by reference into this specification.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A process for preparing an irreversibly dried coal, comprising the steps of:

(a) providing a fluidized bed reactor with a fluidized density of from about 10 to about 40 pounds per cubic foot;

(b) maintaining said fluidized bed reactor at a temperature of from about 225 to about 500 degrees Fahrenheit;

(c) feeding to said fluidized bed reactor coal with a moisture content of from about 5 to about 30 percent and a combined oxygen content of from about 10 to about 20 percent;

(d) feeding to said reactor from about 0.5 to about 3.0 weight percent (by weight of dried coal) of mineral oil with an initial boiling point of at least about 900 degrees Fahrenheit, thereby producing a coated coal; and (e) subjecting said coated coal to said temperature of from about 225 to about 500 degrees Fahrenheit in said reactor for from about 1 to about 5 minutes while simultaneously comminuting and dewatering said coated coal, whereby a comminuted coal is produced wherein:

(1.) after said coated coal is exposed to an ambient environment at a temperature of 25 degrees Centigrade and a relative humidity of 50 percent, it contains less than 2.0 percent of moisture, by weight of coal, (2.) at least about 80 weight percent of the particles of said coated coal are smaller than 74 microns, and (3.) said coal has a combined oxygen content of from about 10 to about 20 weight percent.

2. The process as recited in claim 1, wherein said coal fed to said fluidized bed reactor has a moisture content of from about 10 to about 30 weight percent.

3. The process as recited in claim 1, wherein said coal fed to said fluidized bed reactor has an ash content of at least about 10 weight percent.

4. The process as recited in claim 2, wherein said coal fed to said fluidized bed reactor has an ash content of at least about 10 weight percent.

5. The process as recited in claim 1, wherein at least about 50 percent of the particles of said coal fed to said fluidized bed reactor are within the range of from about 0.25 to about 2.0 inches.

6. The process as recited in claim 1, wherein said fluidized bed reactor has a fluidized density of from about 20 to about 30 pounds per cubic foot.

7. The process as recited in claim 1, wherein said fluidized bed reactor is maintained at a temperature of from about 250 to about 450 degrees Fahrenheit.

8. The process as recited in claim 2, wherein said fluidized bed reactor is maintained at a temperature of from about 250 to about 450 degrees Fahrenheit.

9. The process as recited in claim 6, wherein said fluidized bed reactor is maintained at a temperature of from about 250 to about 450 degrees Fahrenheit.

10. The process as recited in claim 9, wherein air is fed into said fluidized bed reactor.

11. The process as recited in claim 10, wherein said air is at ambient temperature.

12. The process as recited in claim 10, wherein said air is at a temperature greater than ambient temperature.

13. The process as recited in claim 9, wherein liquid water is fed into said fluidized bed reactor.

14. The process as recited in claim 9, wherein said coated coal is subjected to said temperature of from about 250 to about 450 degrees Fahrenheit in said reactor for from about 2 to about 3 minutes while simultaneously comminuting and dewatering said coated coal.

15. The process as recited in claim 14, wherein said mineral oil is residual fuel oil.

16. A coal-liquid slurry which comprises from about 60 to about 82 weight percent of coal, from about 18 to about 40 weight percent of carrier liquid, and from about 0.01 to about 4.0 weight percent (by weight of dry coal) of dispersing agent, wherein:

(a) said slurry contains a slurry consist with a specific surface area of from about 0.8 to about 4.0 square meters per cubic centimeter and an interstitial porosity of less than 20 volume percent, (b) from about 5 to about 70 weight percent of the particles of coal in said slurry are of colloidal size, and (c) said coal has a combined oxygen content of from about 10 to about 20 weight percent.

17. The slurry as recited in claim 16, wherein said carrier liquid is water.

* * * * *